US008692723B2

(12) United States Patent
Liu

(10) Patent No.: US 8,692,723 B2
(45) Date of Patent: Apr. 8, 2014

(54) ANTENNA STRUCTURE

(75) Inventor: Hsien-Wen Liu, New Taipei (TW)

(73) Assignee: Auden Techno Corp., Taoyuan County (TW)

( * ) Notice: Subject to any disclaimer, the term of this patent is extended or adjusted under 35 U.S.C. 154(b) by 187 days.

(21) Appl. No.: 13/310,259

(22) Filed: Dec. 2, 2011

(65) Prior Publication Data

US 2013/0141301 A1 Jun. 6, 2013

(51) Int. Cl.
*H01Q 1/24* (2006.01)

(52) U.S. Cl.
USPC ..... 343/702; 343/700 MS; 343/846

(58) Field of Classification Search
USPC ..... 343/700 MS, 702, 846, 848, 866, 741
See application file for complete search history.

(56) References Cited

U.S. PATENT DOCUMENTS 8,405,556 B2 * 3/2013 Sung et al. ..... 343/702
2009/0322634 A1 * 12/2009 Yun et al. ..... 343/741

* cited by examiner

*Primary Examiner* — Hoang V Nguyen
(74) *Attorney, Agent, or Firm* — Li & Cai Intellectual Property (USA) Office

(57) ABSTRACT

An antenna structure includes a circuit board and at least one antenna circuit. The circuit board includes a ground area and an antenna area. The antenna area is substantially rectangular-shaped and arranged between the ground area and the periphery of the circuit board. The antenna circuit is formed within the antenna area and includes a feeding segment, a border segment and at least one ground segment. The feeding segment is connected to the border segment and the distance from the border segment to the periphery of the circuit board ranges from 0 to 3 millimeters; a substantially 90° bent-structure is formed within the border segment. One end portion of the ground segment is connected to the ground area. Thus an antenna structure which enables the antenna circuit to be formed within the remaining space on the periphery of the circuit board is provided.

19 Claims, 19 Drawing Sheets

ANTENNA STRUCTURE

BACKGROUND OF THE INVENTION

1. Field of the Invention

The present invention relates to an antenna structure; in particular, to an antenna structure which enables the antenna circuit to be formed within the remaining space on the periphery of the circuit board.

2. Description of Related Art

As modern mobile communication products trends toward compact and light weight designs, effective utilization of limited space within such products becomes a crucial design consideration. FIG. 9 illustrates a conventional Smartphone where a system circuit board 1*a* and two antenna substrates 2*a* are arranged within.

The system circuit board 1*a* is connected to electronic components such as memory devices, micro processors or monitors. Generally, when planning the circuit layout of the circuit board 1, it is not possible to utilize the entire circuit board 1 surface. In other words, a remaining space on and around the periphery of the circuit board 1 is usually not effectively utilized.

Additionally, the space around the periphery of the conventional system circuit board 1*a* is often reserved for accommodating a separate stand-alone antenna circuit board 2*a*. The stand-alone antenna circuit board 2*a*, however, would occupy a significant amount of precious space, thereby hindering further miniaturization of the portable Smartphone.

SUMMARY OF THE INVENTION

The object of the present invention is to provide an antenna structure wherein the antenna circuit is formed on a circuit board connected to electrical devices.

An embodiment of the present invention provides an antenna structure, comprising a circuit board having a centrally arranged ground area for connecting at least one electronic device and an antenna area shaped substantially as a rectangular loop defined on a surface thereof, wherein the antenna area is defined between the ground area and the periphery of the circuit board, and at least one antenna circuit formed within the antenna area wherein the antenna circuit includes a feeding segment, a border segment and at least one ground segment. The feeding segment is connected to the border segment and the distance from the border segment to the periphery of the circuit board ranges from 0 to 3 millimeters, wherein border segment includes at least one 90° bent structure, and one end portion of the ground segment is connected to the ground area.

Ideally the antenna structure further comprises an inner antenna circuit formed within the antenna area and arranged between the antenna circuit and the ground segment. The inner antenna circuit includes an inner feeding segment, an adjusting segment and at least one inner ground segment. The inner feeding segment is connected to the adjusting segment, the two end portions of the inner ground segment are connected respectively with the end portion of the adjusting segment and the ground area.

Ideally the inner ground segment includes a high-frequency inner ground segment and a low-frequency ground inner segment, likewise the adjusting segment includes a high-frequency adjusting segment and a low-frequency adjusting segment. The high-frequency adjusting segment and the low-frequency adjusting segment are formed by extending oppositely from the inner feeding segment. The length of the high-frequency adjusting segment is shorter than that of the low-frequency adjusting segment, the two end portions of the high-frequency inner ground segment are connected respectively with the ground area and the end portion of the high-frequency adjusting segment, likewise the two end portions of the low-frequency inner ground segment are connected respectively with the ground area and the end portion of the low-frequency adjusting segment.

In conclusion, the embodiment of the present invention provides an antenna structure where the antenna area of the circuit board is equivalent to the remaining space on the periphery of a conventional system circuit board, and by forming the antenna circuit of the antenna structure on the antenna area of the circuit board allows efficient utilization of all the space within the circuit board, thereby enabling the electrical devices to achieve a relatively smaller design.

In order to further the understanding regarding the present invention, the following embodiments are provided along with illustrations to facilitate the disclosure of the present invention.

DETAILED DESCRIPTION OF THE PREFERRED EMBODIMENTS

The aforementioned illustrations and following detailed descriptions are exemplary for the purpose of further explaining the scope of the present invention. Other objectives and advantages related to the present invention will be illustrated in the subsequent descriptions and appended drawings.

[The First Embodiment]

Figure 1:
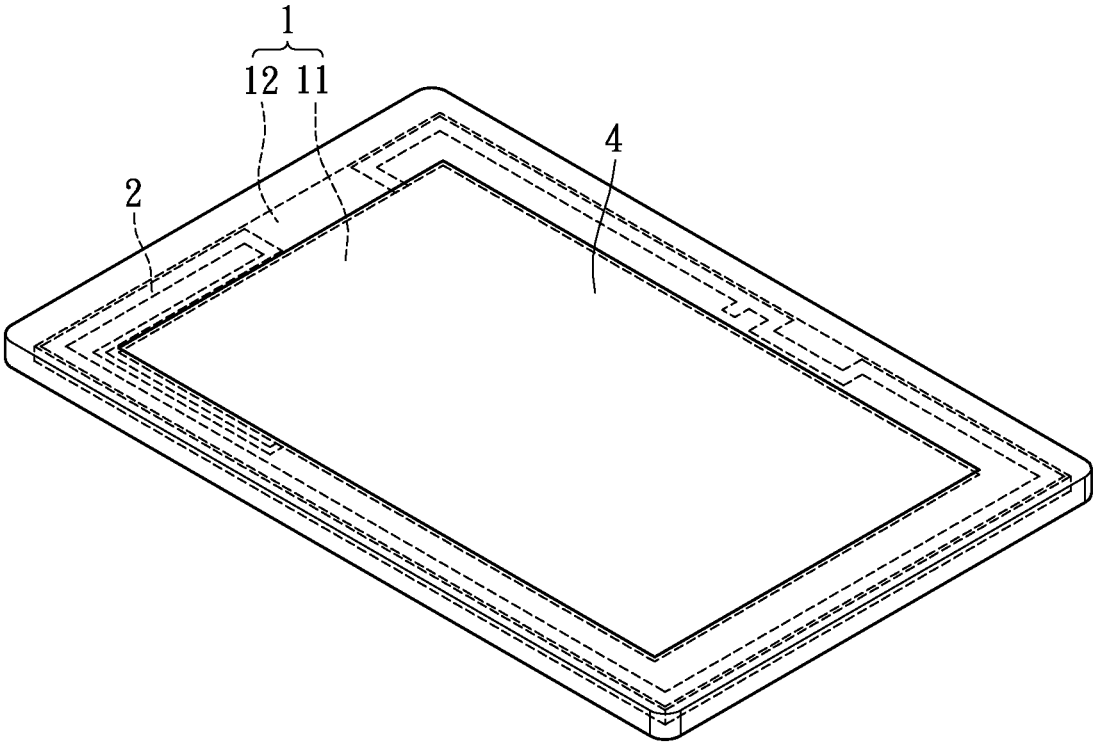
FIG. 1 shows a three-dimensional perspective view of the first embodiment in accordance with the present invention.
Figure 1A:
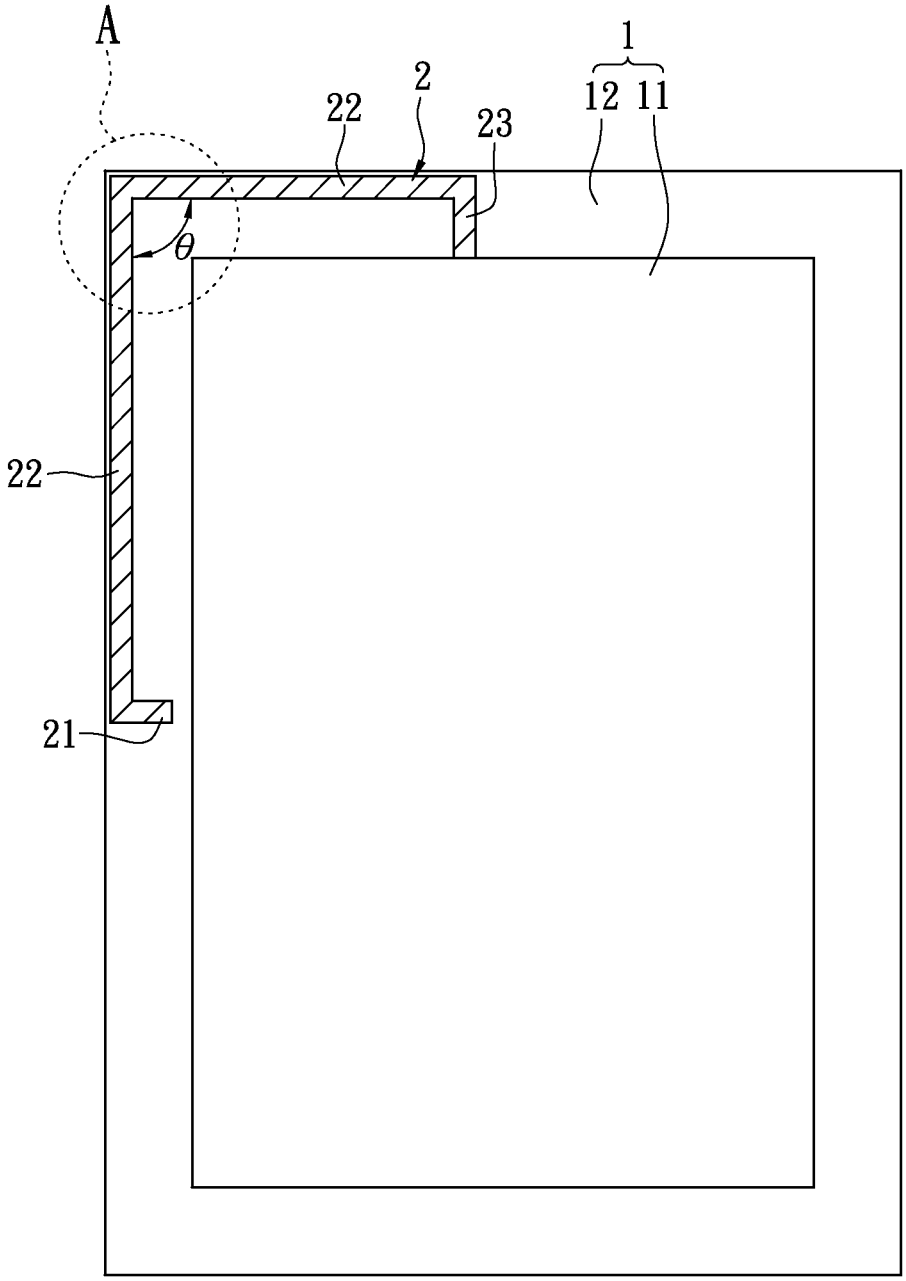
FIG. 1A shows a perspective view of the first embodiment in accordance with the present invention, wherein the border segment includes a substantially 90° bent structure.
Figure 1B:
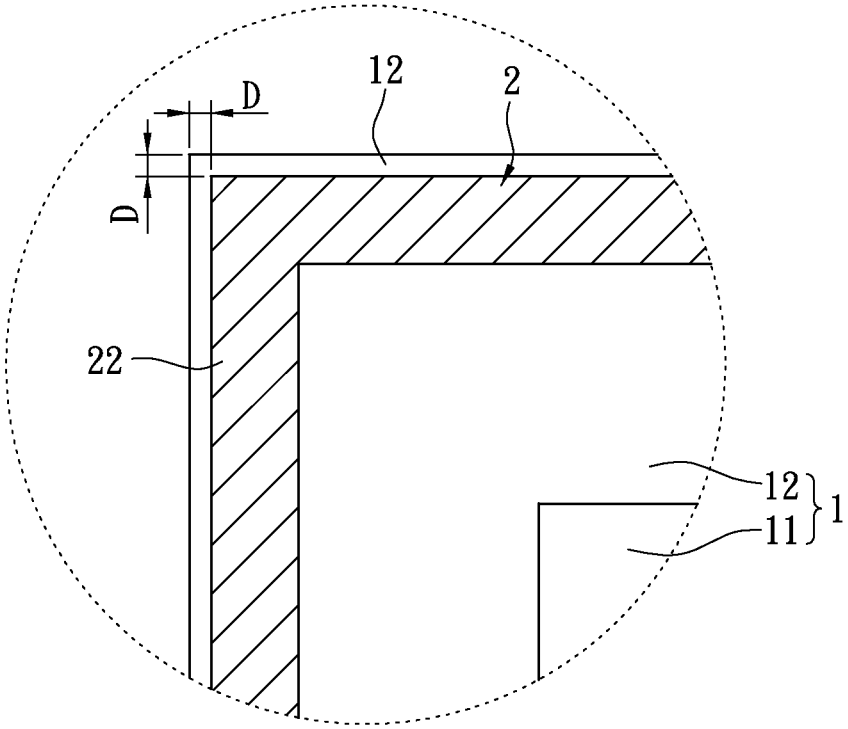
FIG. 1B shows a partially magnified perspective view of the first embodiment in accordance with the present invention.
Figure 1C:
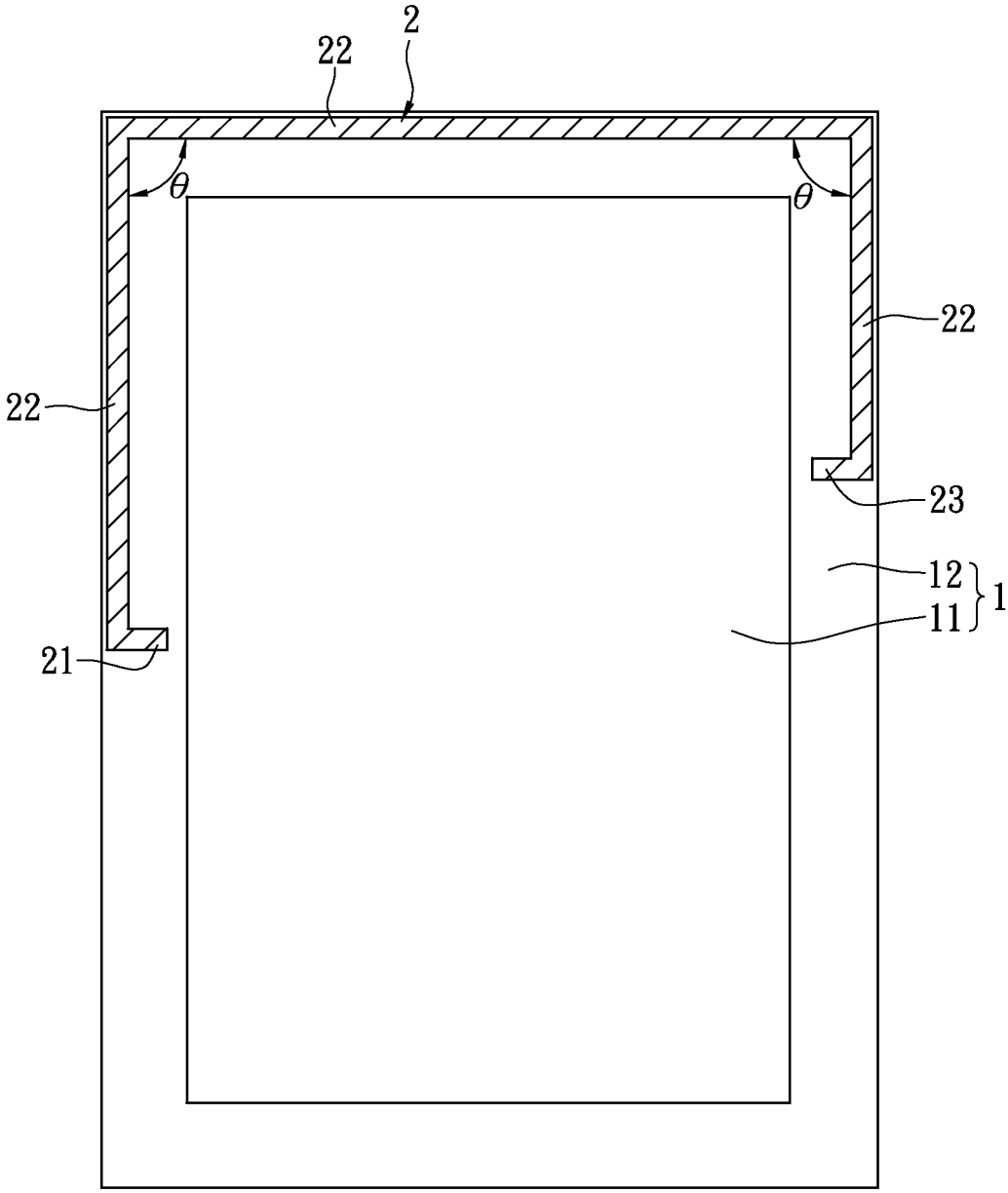
FIG. 1C shows a perspective view of the first embodiment in accordance with the present invention, wherein the border segment includes two substantially 90° bent structure.
Figure 1D:
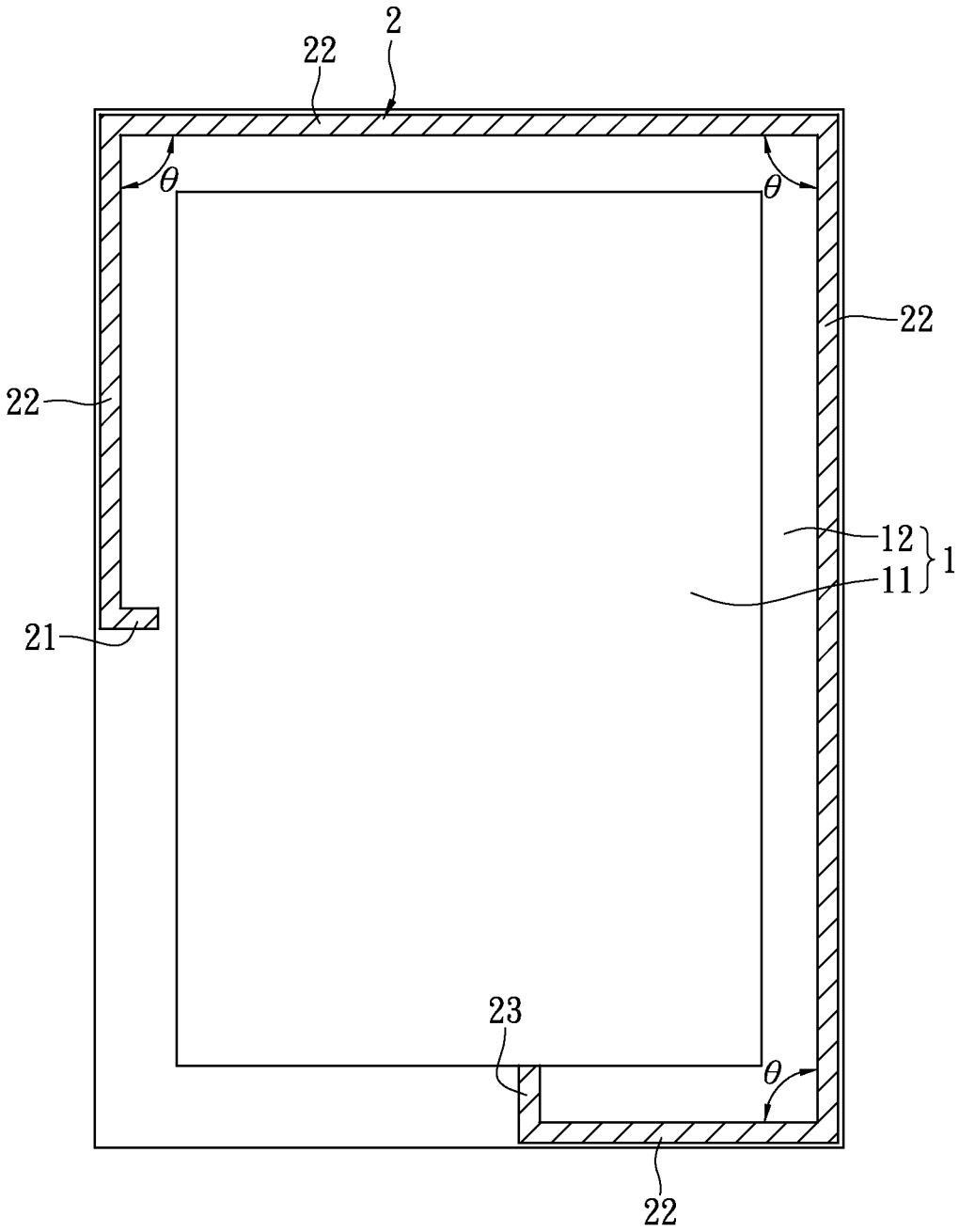
FIG. 1D shows a perspective view of the first embodiment in accordance with the present invention, wherein the border segment includes three substantially 90° bent structure.
Figure 1E:
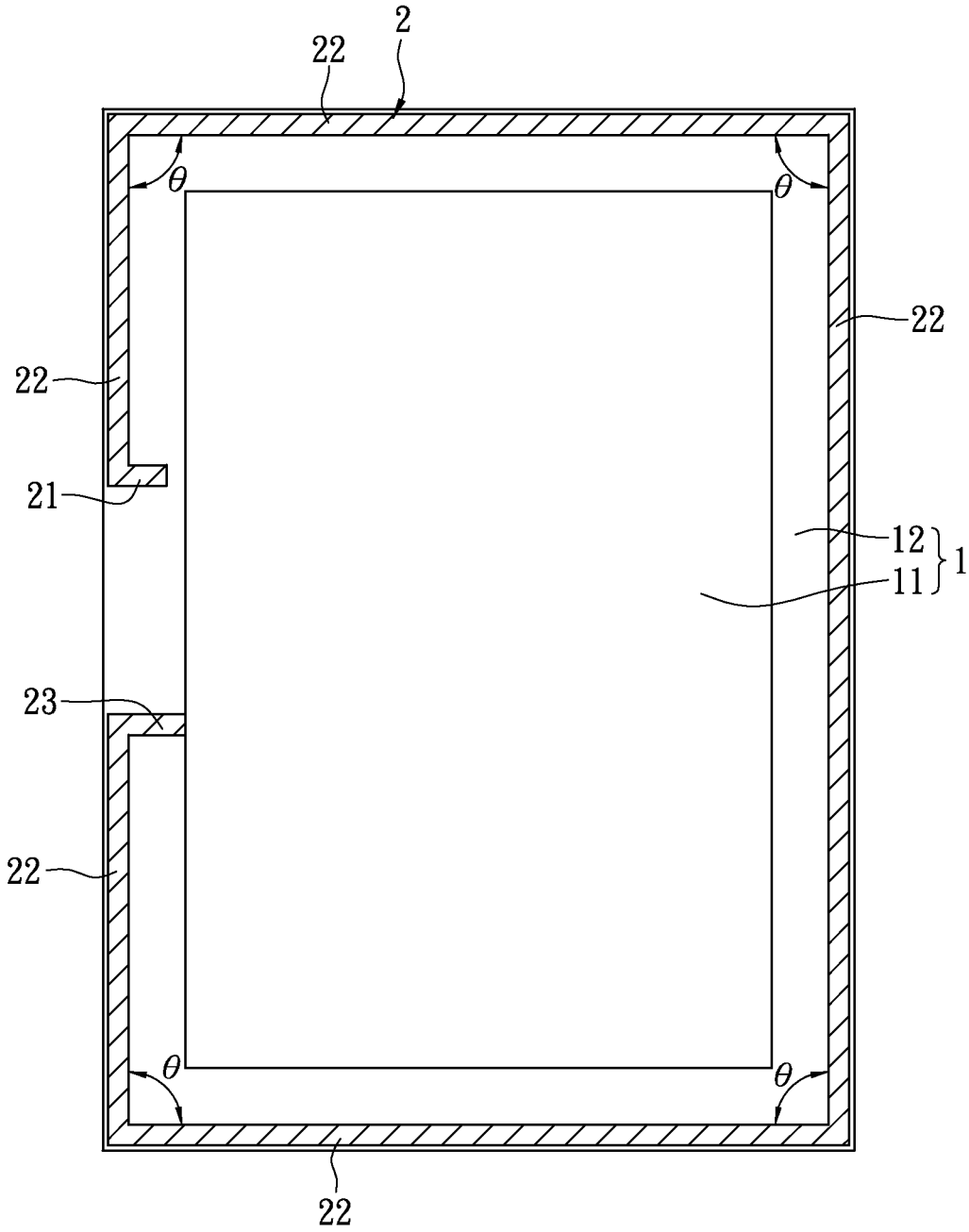
FIG. 1E shows a perspective view of the first embodiment in accordance with the present invention, wherein the border segment includes four substantially 90° bent structure.

With reference to FIGS. 1-1E which shows the first embodiment in accordance with the present invention wherein FIG. 1 shows a three-dimensional perspective view of the first embodiment and FIGS. 1A-1E shows the perspective view of the first embodiment.

Referring again to FIG. 1 which shows an antenna structure comprising: a rectangular circuit board 1 and an antenna circuit 2 formed thereon wherein the antenna circuit 2 is formed directly on the circuit board 1 during the production thereof, this implies that the circuit board 1 and the antenna circuit 2 are integrally formed as a single unit. During practical applications, however, the circuit board 1 can also be manufactured before the antenna circuit 2 is formed thereon.

The circuit board 1 has a centrally arranged ground area 11 for connecting at least one electrical device 4 and an antenna area 12 shaped substantially as a rectangular loop defined on a surface thereof, wherein the antenna area is defined between the ground area 11 and the periphery of the circuit board 1.

To simplify the understanding of the arrangement of the ground area 11 and the antenna area 12 on the surface of the circuit board 1 of the instant embodiment, the following example is adopted to provide further illustrations.

If the circuit board 1 of the instant embodiment is applied to mobile phones, (or other electrical devices such as Tablet Computer), the ground area 11 of the circuit board 1 will be connected to electronic components such as memory devices, microprocessors, monitors and etc. When planning the circuit layout of the circuit board 1, it is not possible to utilize the entire circuit board 1 surface to connect with the electrical devices, this implies that a remaining space on and around the periphery of the circuit board 1 is usually not effectively utilized wherein this particular remaining space refers to the antenna area 12 of the instant embodiment.

Furthermore, the concrete structure of the circuit board 1 of the instant embodiment is not limited to by this, this implies that the circuit board 1 can be a single-layered or a multi-layered structure.

Referring now to FIG. 1A, the antenna circuit 2 is formed in the antenna area 12 of the circuit board 1 wherein the antenna circuit 2 includes a feeding segment 21, a border segment 22 and a ground segment 23 wherein an end portion of the ground area 23 is connected to the ground area 11.

The two end portions of the border segment 22 are connected respectively with an end portion of the feeding segment 21 and the other end of the ground segment 23, and the distance (D) from the border segment 22 to the periphery of the circuit board 1 ranged from 0 to 3 millimeters (shown in FIG. 1B). A shorter distance (D) from the border segment 22 to the periphery of the circuit board 1 will achieve a higher space efficiency of the antenna area 12.

Additionally, the border segment 22 may include one to four 90° bent-structures depending on the given bandwidth (the 0 is shown in the FIGS. 1A, and 1C-1E). In other words, a longer length of the border segment 22 is required if a lower bandwidth is given, and the amount of bent-structures formed will also increase. The above description utilizes 90° bent-structures for example, however, the bent-structures can be bend proximately to 90° under practical applications.

In addition, the instant embodiment utilizes the feeding segment 21 formed in the longer portion of the antenna area 12 for example, the feeding segment 21, however, can be formed in the shorter length or corner portions (not shown) of the antenna area 12 under practical applications.

[The Second Embodiment]

Figure 2:
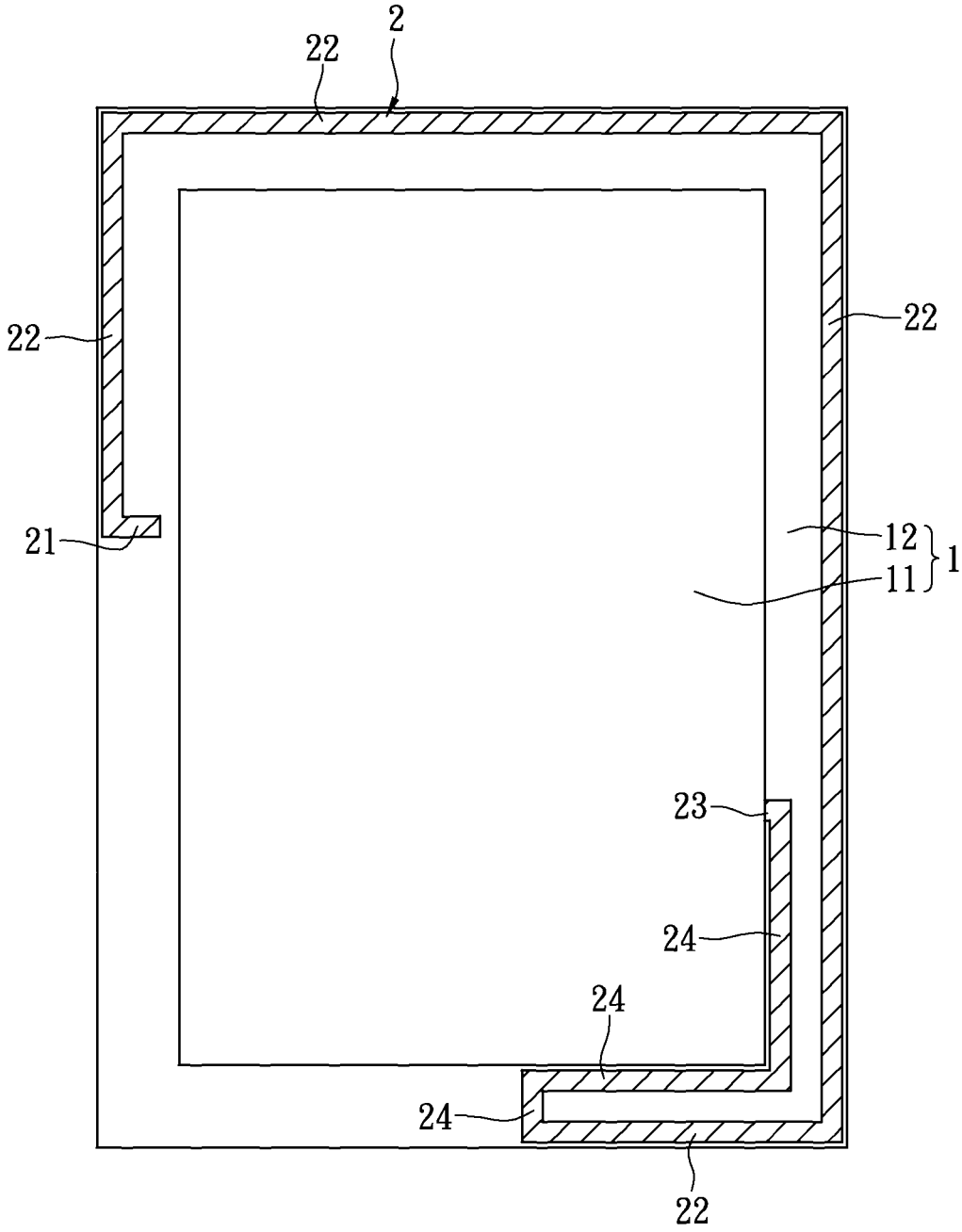
FIG. 2 shows a perspective view of the second embodiment in accordance with the present invention.

Please refer to FIG. 2 which shows the second embodiment of the present invention. The instant embodiment is similar to the first embodiment except the difference that the antenna circuit 2 in the instant embodiment can further includes an extended segment 24 of which the length and shape thereof can be adjusted to meet the designer's requirements.

Specifically, the extended segment 24 is arranged between the border segment 22 and the ground area 11, this implies that the two end portions of the extended segment 24 are connected respectively with the end portion of the border segment 22 and the other end of the ground segment 23. Thus, the border segment 22 enables the antenna circuit 2 to be in accordance with the given bandwidth by adjusting the length of the extended segment 24.

Additionally, the border segment 22 includes three 90° bent-structures in the instant embodiment for example, however, the border segment 22 may also include one, two or four 90° bent-structures under practical applications.

[The Third Embodiment]

Figure 3:
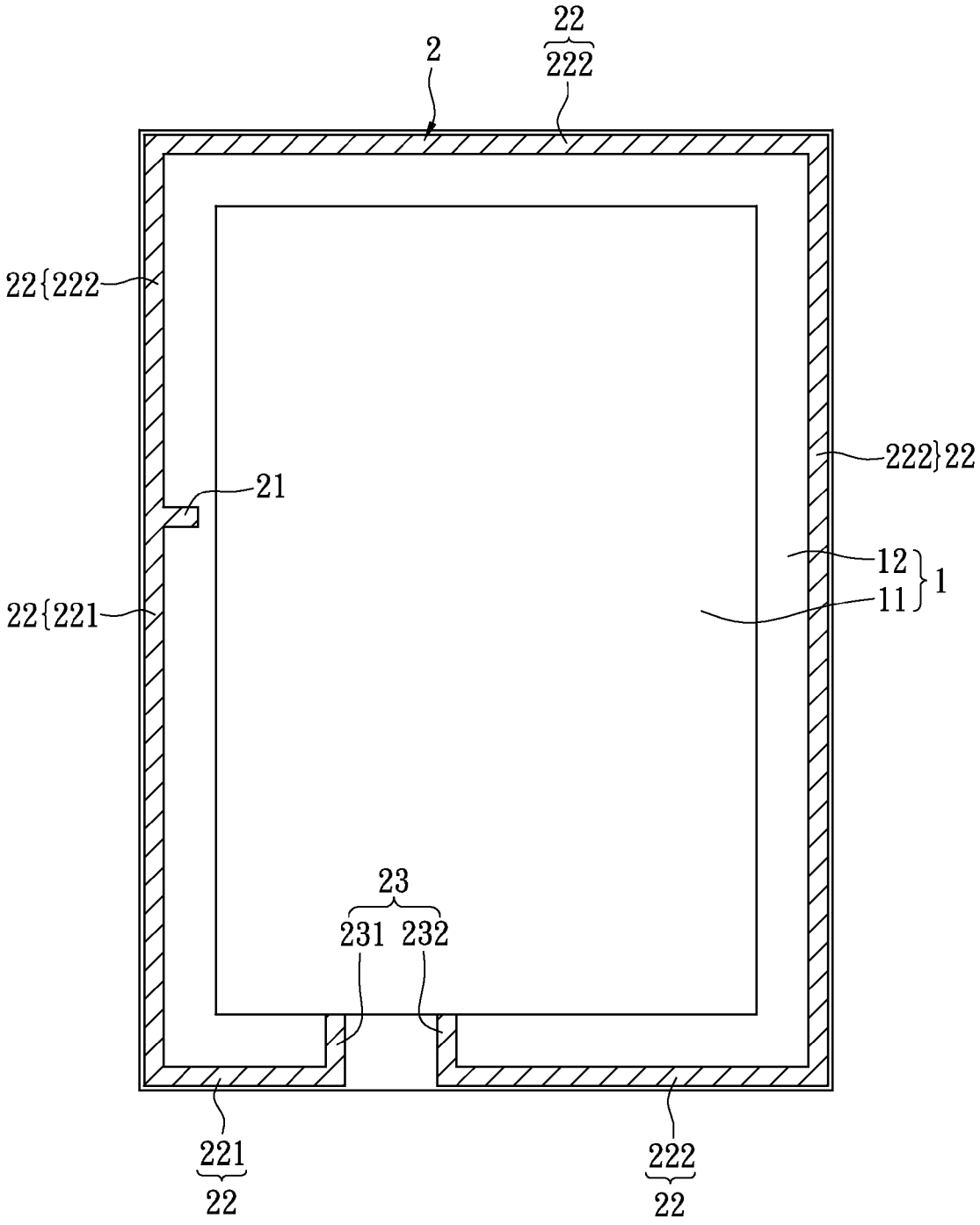
FIG. 3 shows a perspective view of the third embodiment in accordance with the present invention.

Referring now to FIG. 3 which shows the third embodiment of the present invention. The instant embodiment is similar to the first embodiment except the difference that the border segment 22 in the instant embodiment includes a high-frequency border segment 221 and a low-frequency border segment 222. The antenna circuit 2 has two ground segments 23, this implies that one of the ground segments 23 is a high-frequency ground segment 231, while the other is a low-frequency ground segment 232.

Specifically, the high-frequency border segment 221 and the low-frequency border segment 222 are respectively formed by extending oppositely from the feeding segment 21, and the two end portions of the high-frequency ground segment 231 are connected respectively with the high-frequency border segment 221 and the ground area 11, whereas the two end portions of the low-frequency border segment 232 are connected to the low-frequency border segment 222 and the ground area 11.

Furthermore, the high-frequency border segment 221 includes three 90° bent-structures while the low-frequency border segment 222 includes one 90° bent-structure in the instant embodiment for example. However, under practical applications, as long as the length of the high-frequency border segment 221 is shorter than that of the low-frequency border segment 222, and more than one 90° bent-structures included by the high-frequency border segment 221 and the low-frequency border segment 222 will do. The actual relationship of the length of the high-frequency border segment 221 and the low-frequency border segment 222 shall depend on the given bandwidth.

[The Forth Embodiment]

Figure 4A:
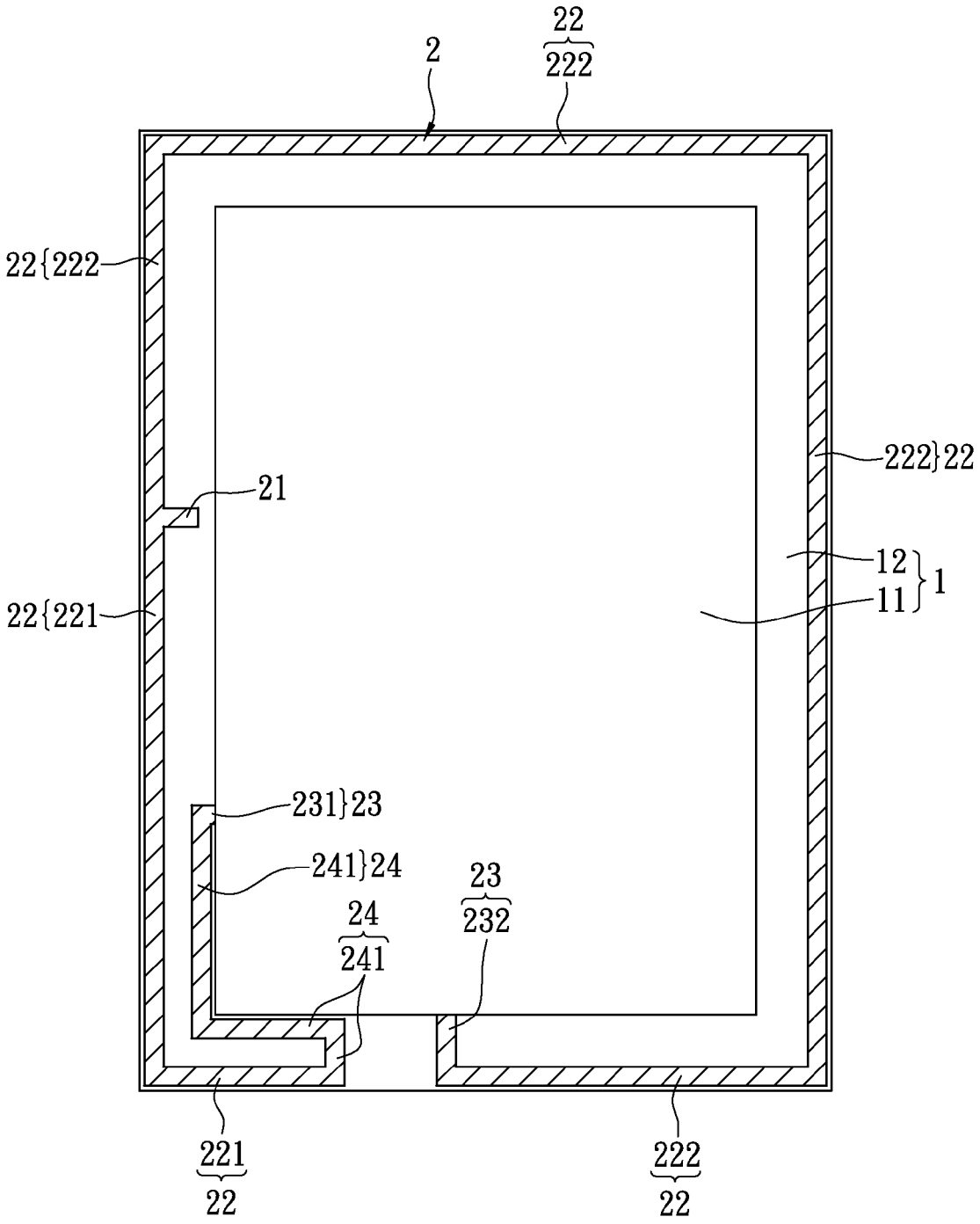
FIG. 4A shows a perspective view of the forth embodiment in accordance with the present invention, wherein the extended segment is a high-frequency extended segment.
Figure 4B:
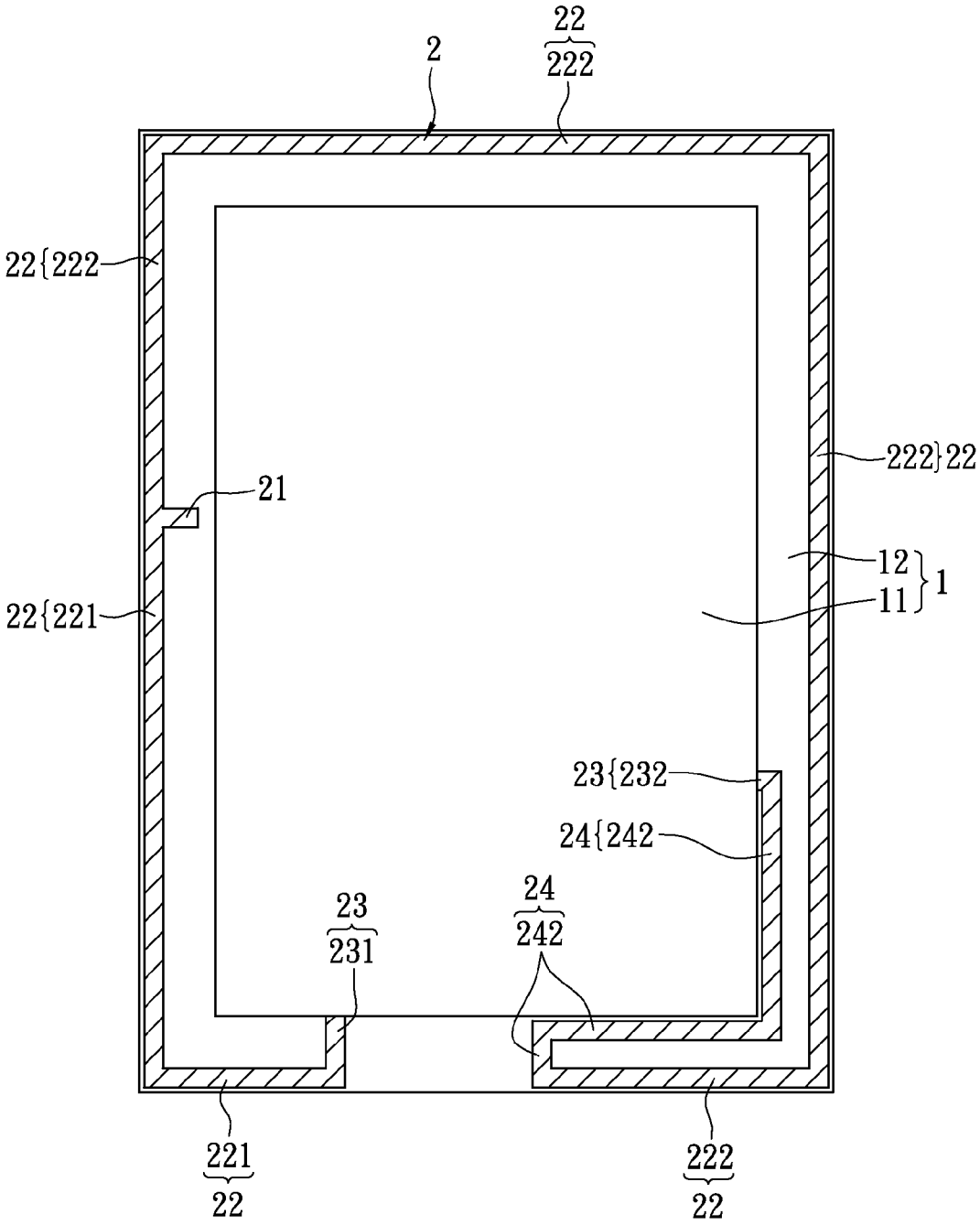
FIG. 4B shows a perspective view of the forth embodiment in accordance with the present invention, wherein the extended segment is a low-frequency extended segment.
Figure 4C:
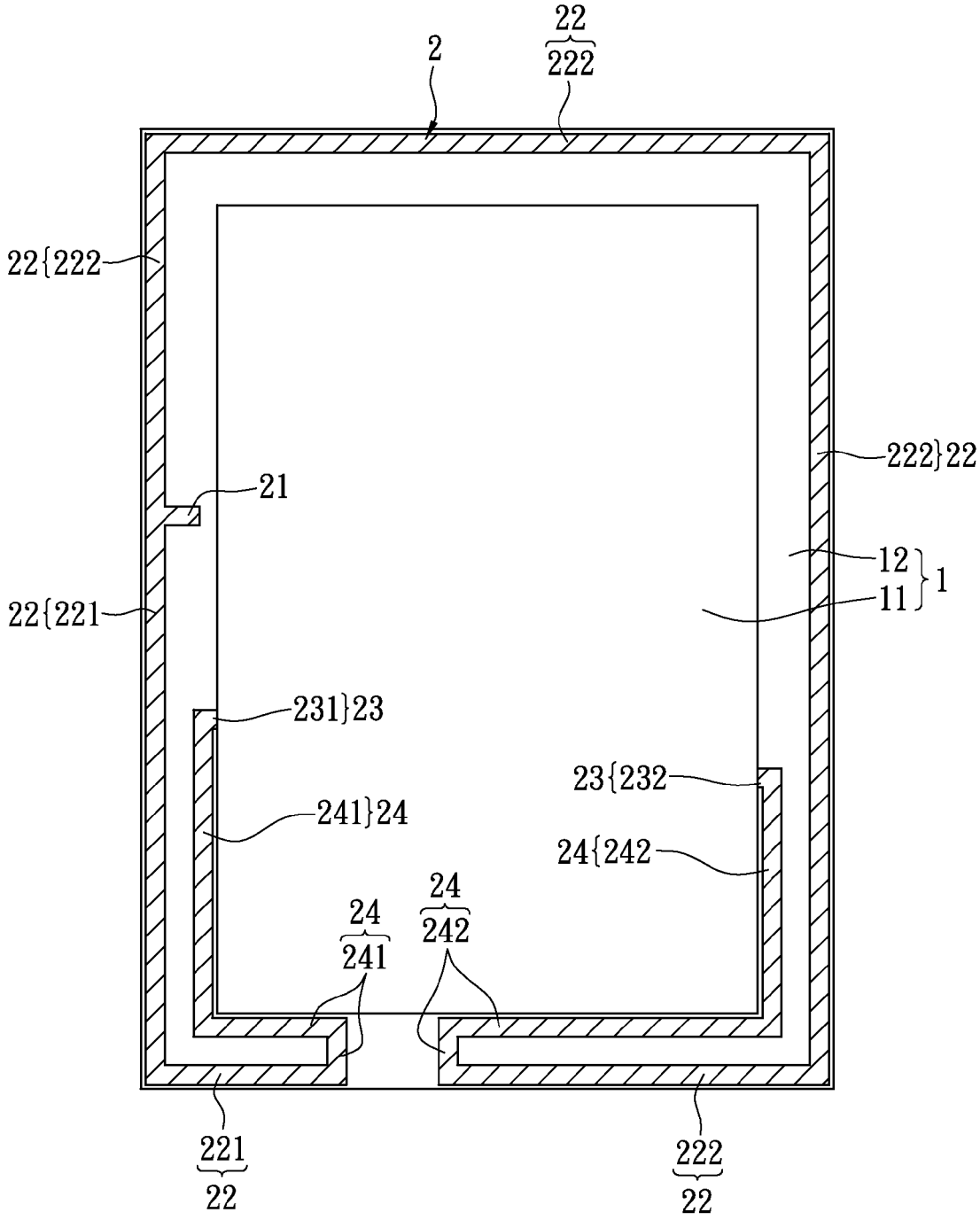
FIG. 4C shows a perspective view of the forth embodiment in accordance with the present invention, wherein the extended segment is both the high-frequency and low-frequency extended segment.

Referring now to FIGS. 4A-4C which shows the forth embodiment of the present invention. The instant embodiment is similar to the third embodiment except the difference that the antenna circuit 2 in the instant embodiment can further includes at least one extended segment 24, this implies that the extended segment 24 can be either a high-frequency extended segment 241 or a low-frequency extended segment 242.

When the extended segment 24 is the high-frequency extended segment 241, shown in FIG. 4*a*, the high-frequency extended segment 241 is arranged between the high-frequency border segment 221 and the ground area 11, this implies that the high-frequency ground segment 231 shown in FIG. 3 is replaced by the high-frequency extended segment 241 and the high-frequency ground segment 231 shown in FIG. 4.

Specifically, the two end portions of the high-frequency extended segment 241 is connected respectively with the end portion of the high-frequency border segment 221 and the other end of the high-frequency ground segment 231. By doing so, the high-frequency border segment 221 enables the antenna circuit 2 to be in accordance with the given high-frequency bandwidth by adjusting the length of the high-frequency extended segment 241. Meanwhile, the end portion of the low-frequency border segment 222 is connected to the other end of the low-frequency ground segment 232.

In addition, when the extended segment 24 is the low-frequency extended segment 242, shown in FIG. 4B, the low-frequency extended segment 242 is arranged between the low-frequency border segment 222 and the ground area 11, this implies that the low-frequency ground segment 232 shown in FIG. 3 is replaced by the low-frequency extended segment 242 and the low-frequency ground segment 232 shown in FIG. 4B.

Specifically, the two end portions of the low-frequency extended segment 242 are connected respectively with the end portion of the low-frequency border segment 222 and the other end of the low-frequency ground segment 232. By doing so, the low-frequency border segment 222 enables the antenna 2 to be in accordance with the given low-frequency bandwidth by adjusting the length of the low-frequency extended segment 242. Meanwhile, an end portion of the low-frequency border segment 222 is connected to the other end of the low-frequency ground segment 232.

The extended segment 24 can also be both the high-frequency extended segment 241 and the low-frequency extended segment 242 (shown in FIG. 4C), this implies that the high-frequency ground segment 231 and the low-frequency ground segment 232 are being replaced at the same time whereas the method of replacing is described on the above hence shall not be described again.

Additionally, the high-frequency border segment 221 includes three 90° bent-structures while the low-frequency border segment 222 includes one 90° bent-structure in the instant embodiment for example. However, under practical application, as long as the total length of the high-frequency border segment 221 and the high-frequency extended segment 241 is shorter than that of the low-frequency border segment 222 and the low-frequency extended segment 222, meanwhile the high-frequency border segment 221 and the low-frequency border segment 222 include at least one 90° bent-structure will do. However, the actual total length shall depend on the given bandwidth.

[The Fifth Embodiment]

Figure 5A:
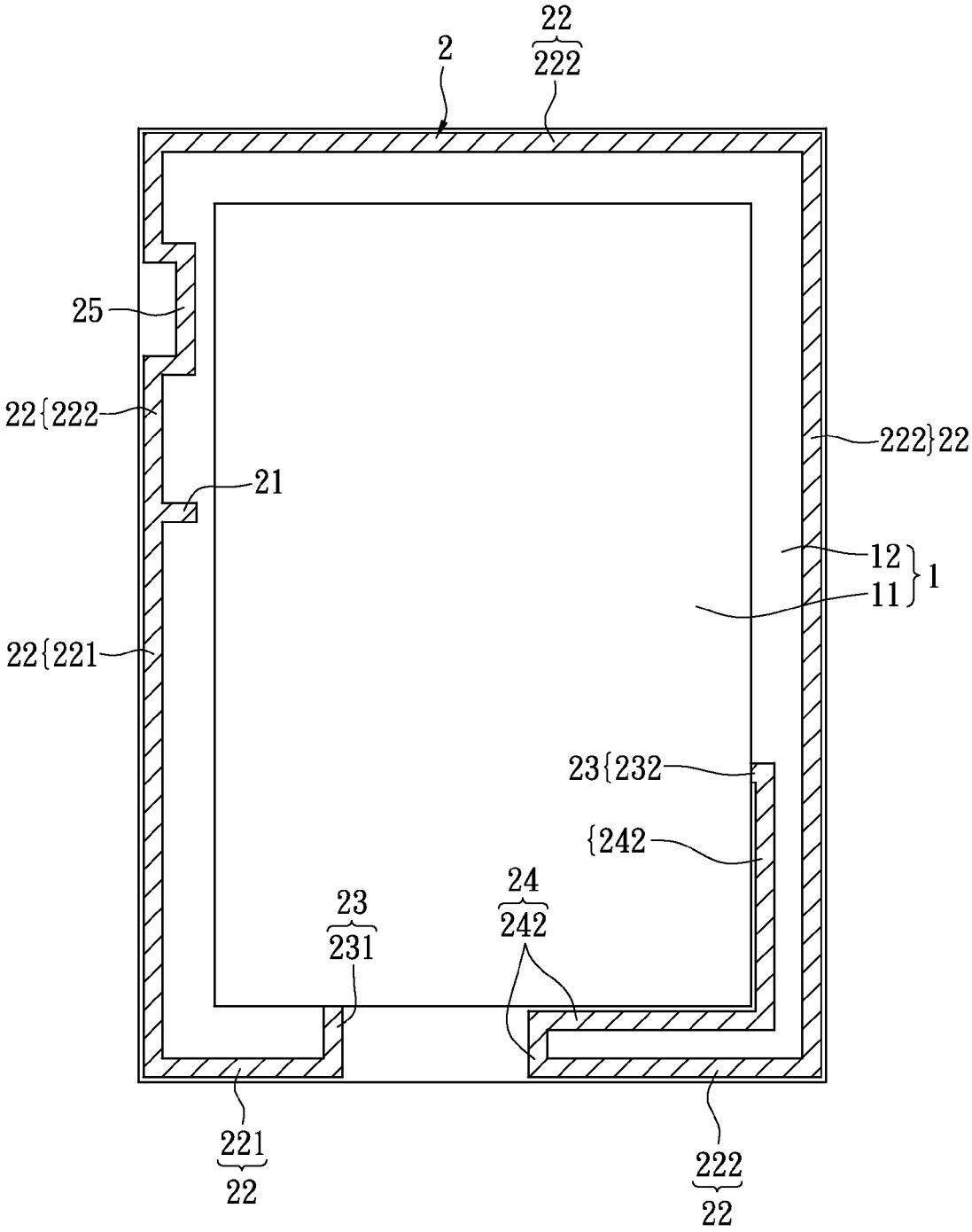
FIG. 5A shows a perspective view of the fifth embodiment in accordance with the present invention, wherein the in-bending segment is formed within the low-frequency border segment.
Figure 5B:
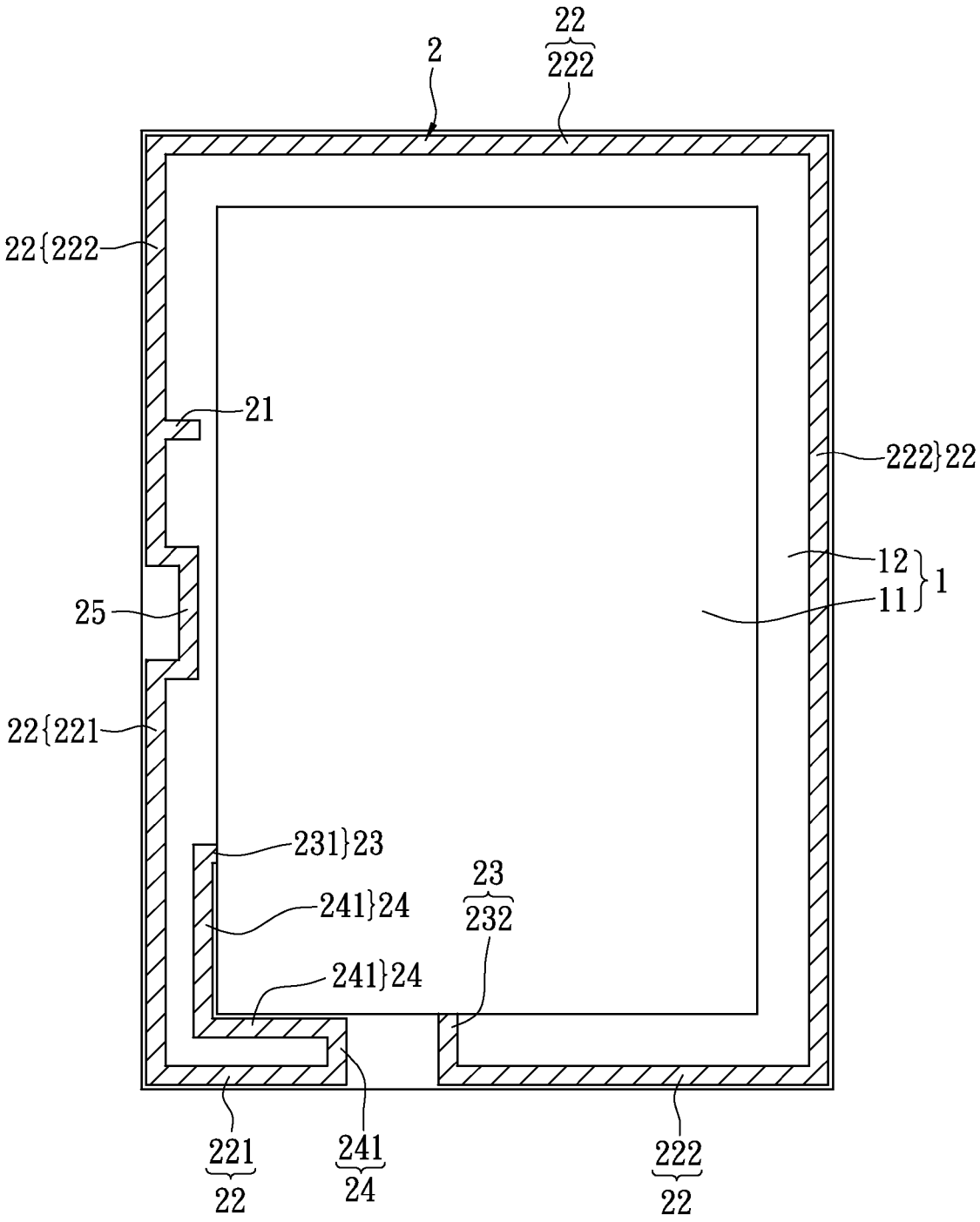
FIG. 5B shows a perspective view of the fifth embodiment in accordance with the present invention, wherein the in-bending segment is formed within the high-frequency border segment.

Please refer to FIGS. 5A & 5B which show the fifth embodiment of the instant embodiment. The instant embodiment is an extended design of the aforementioned embodiments (referring to the first-forth embodiments), this implies that the antenna circuit 2 in the instant embodiment can further includes an in-bending segment 25 by bending the border segment 22 toward the ground area 11.

Specifically, shown in FIG. 5A, in order to be in accordance with the given low-frequency bandwidth, at least one in-bending segment 25 can be formed by bending the low-frequency border segment 222 toward the ground area 11 so as to achieve a longer extension, thereby enabling the antenna circuit 2 to be in accordance with given low-frequency bandwidth.

Furthermore, at least one in-bending segment 25 can also be formed by bending the high-frequency border segment 221 toward the ground area 11 (shown in FIG. 5B) so as to achieve a longer extension, thereby enabling the antenna circuit 2 to be in accordance with given high-frequency bandwidth.

In addition, the instant embodiment utilizes the antenna circuit 2 shown in FIGS. 5A & 5B for example, however this shall not be limited to by this under practical applications.

[The Sixth Embodiment]

Figure 6A:
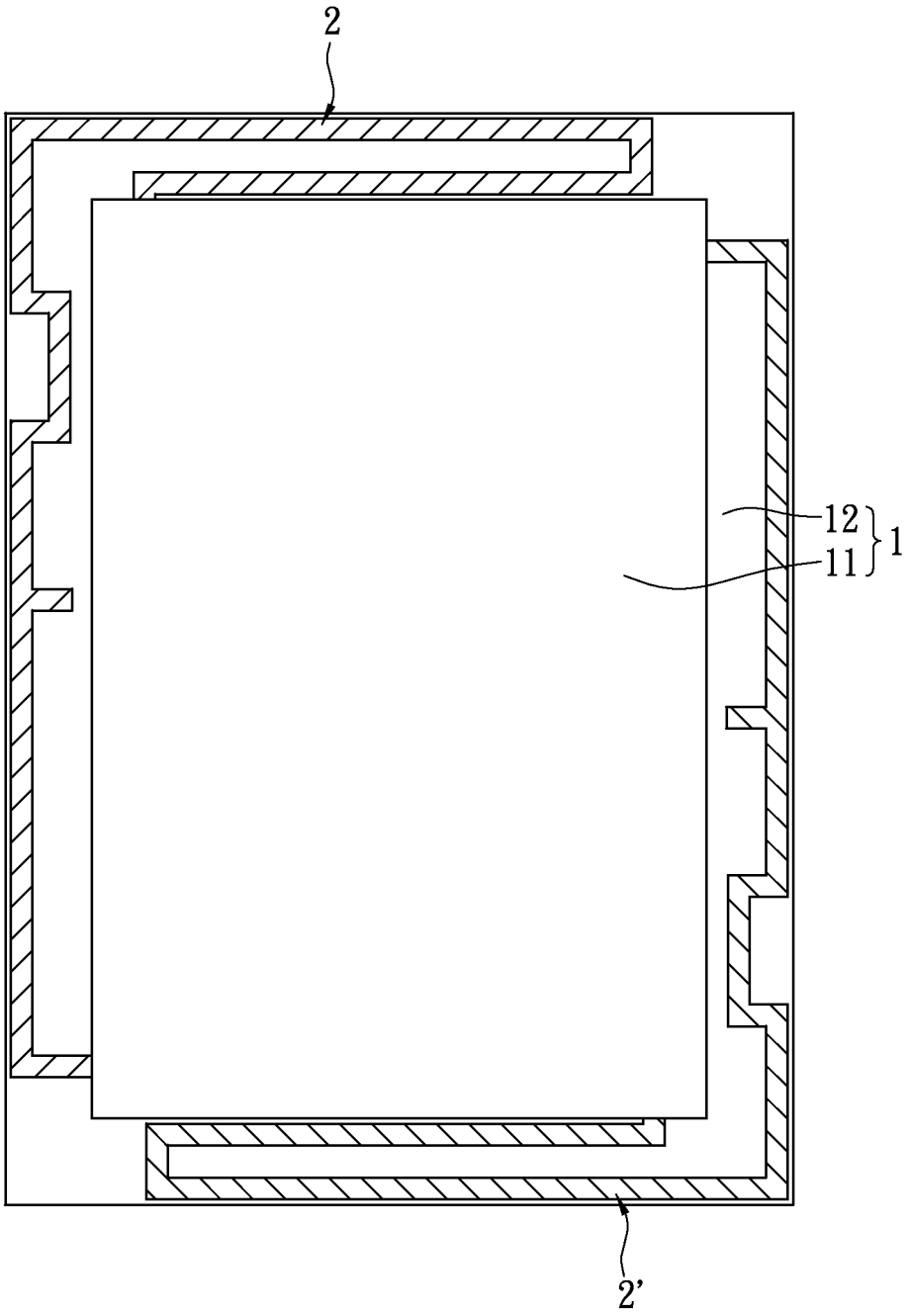
FIG. 6A shows a perspective view of the sixth embodiment in accordance with the present invention, wherein the two antenna circuits are arranged on the two sides of the diagonal of the circuit board.
Figure 6B:
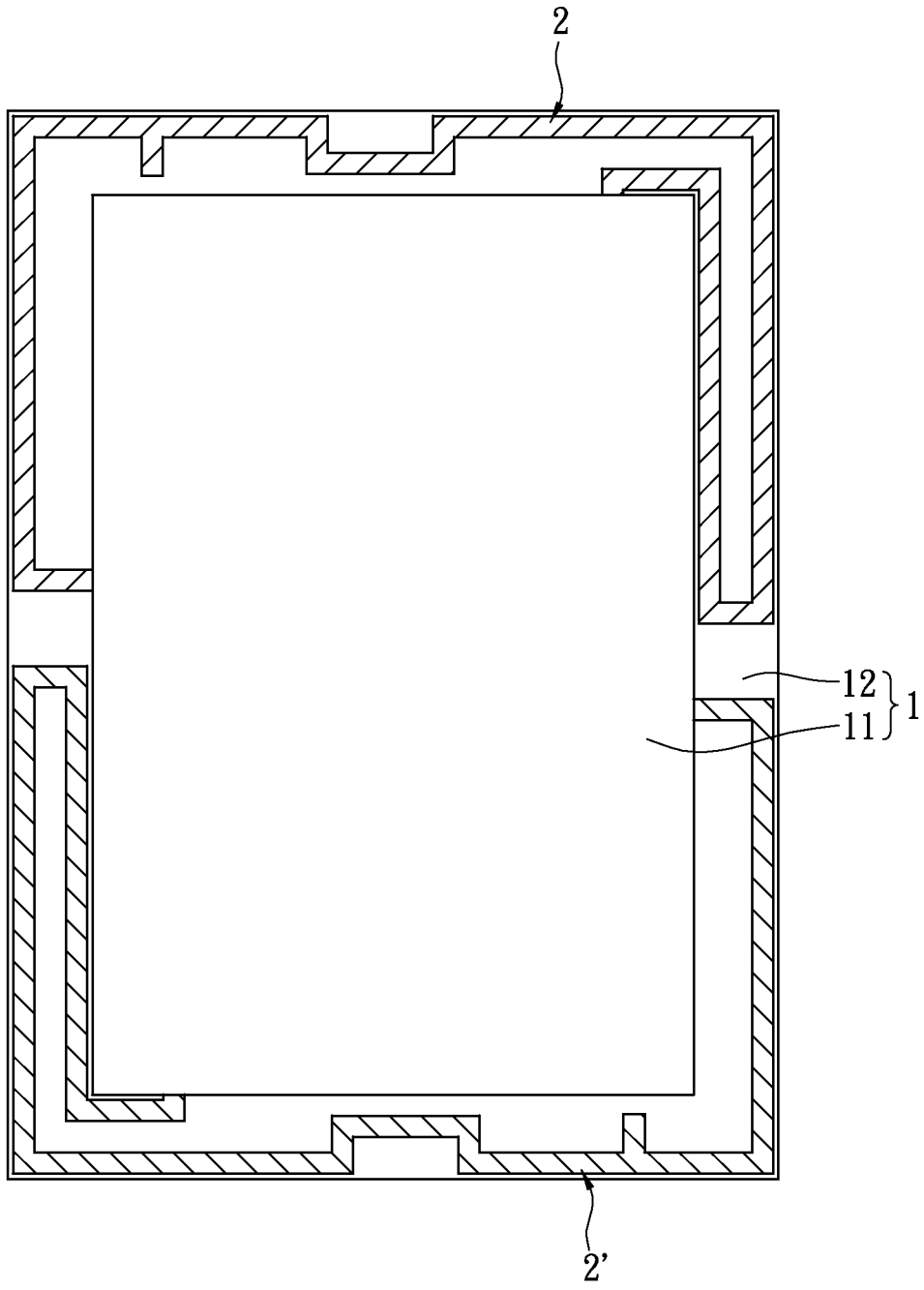
FIG. 6B shows a perspective view of the sixth embodiment in accordance with the present invention, wherein the two antenna circuits are arranged on the two sides of the bisector of the border of the circuit board.
Figure 6C:
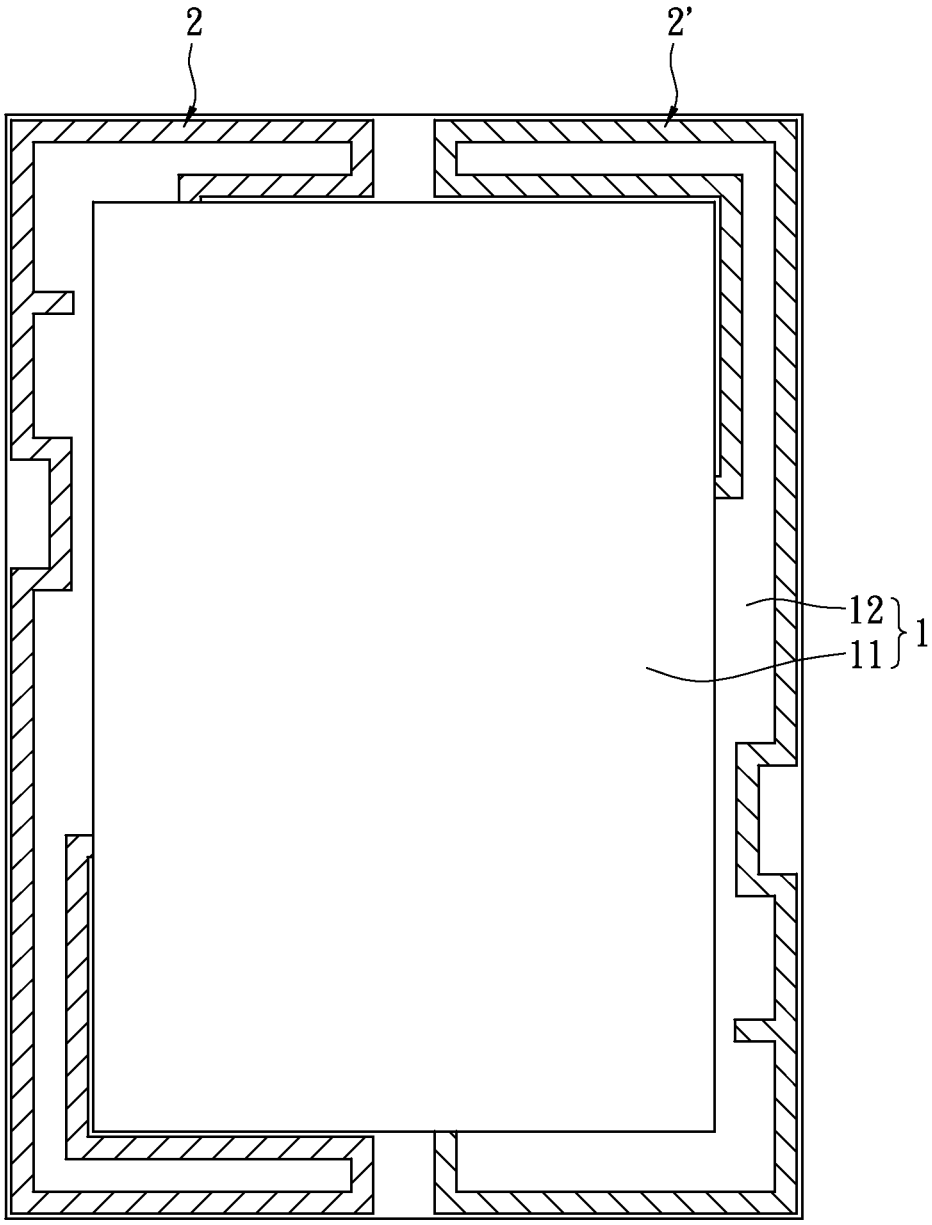
FIG. 6C shows another perspective view of the sixth embodiment in accordance with the present invention, wherein the two antenna circuits are arranged on the two sides of the bisector of the border of the circuit board.

Referring now to FIGS. 6A-6C which show the sixth embodiment of the instant embodiment. The instant embodiment is an extended design of the aforementioned first-fifth embodiments, this implies that there are two antenna circuit 2, 2', wherein the two antenna circuits 2, 2' are formed in the antenna area 12 of the circuit board 1.

The two antenna circuits 2, 2' are described in the first-fifth embodiments, however the concrete designs may not be the same, this implies that the two antenna circuits 2, 2' can be formed depending on the given high-frequency and low-frequency bandwidth, thereby enabling the antenna structure of the present invention to be applicable to two to four bandwidths.

Furthermore, the two antenna circuits 2, 2' can be arranged on the two sides of the area bisector of the circuit board 1 in the antenna area 12. This implies that the two antenna circuits 2, 2' are arranged on the two sides of the diagonal of the circuit board 1 in the antenna area 12 (show in FIG. 6A), or arranged on the two sides of the perpendicular bisector of the border of the circuit board 1 in the antenna area 12 (shown in FIGS. 6B & 6C).

In addition, the instant embodiment, the area bisector of the circuit board 1 utilizes the diagonal of the circuit board 1 and the perpendicular bisector of the border of the circuit board 1 for example, however this shall not be limited to by this under practical applications.

[The Seventh Embodiment]

Figure 7:
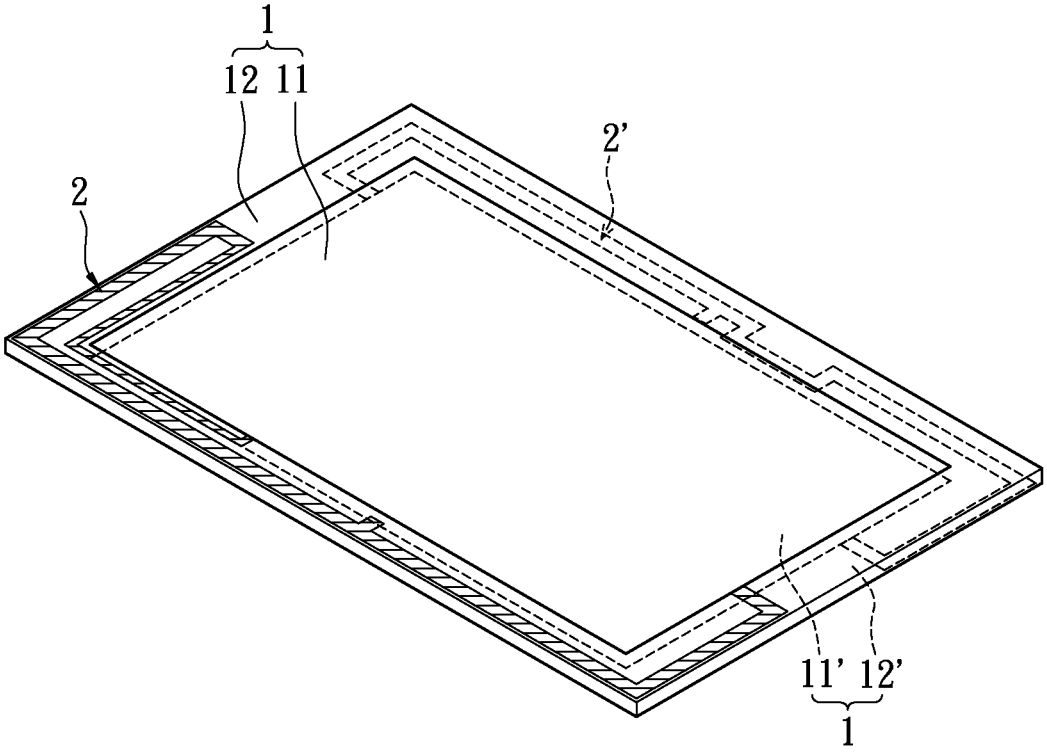
FIG. 7 shows a three-dimensional perspective view of the seventh embodiment in accordance with the present invention.

Please refer to FIG. 7 which shows the seventh embodiment of the instant embodiment. The instant embodiment is an extended design of the aforementioned first-fifth embodiments. This implies that each of the two relative surfaces of the circuit board 1 in the instant embodiment forms ground areas 11, 11' and antenna areas 12, 12' wherein there are two antenna circuits 2, 2' respectively formed on the antenna areas 12, 12' of the two relative surfaces of the circuit board 1.

The two antenna circuits 2, 2' are described in the aforementioned first-fifth embodiments, however the concrete design may not be exactly the same, this implies that the two antenna circuits 2, 2' can be formed depending on the given high-frequency and low-frequency bandwidth, thereby enabling the antenna structure of the present invention to be applicable from two to four bandwidths.

[The Eighth Embodiment]

Figure 8:
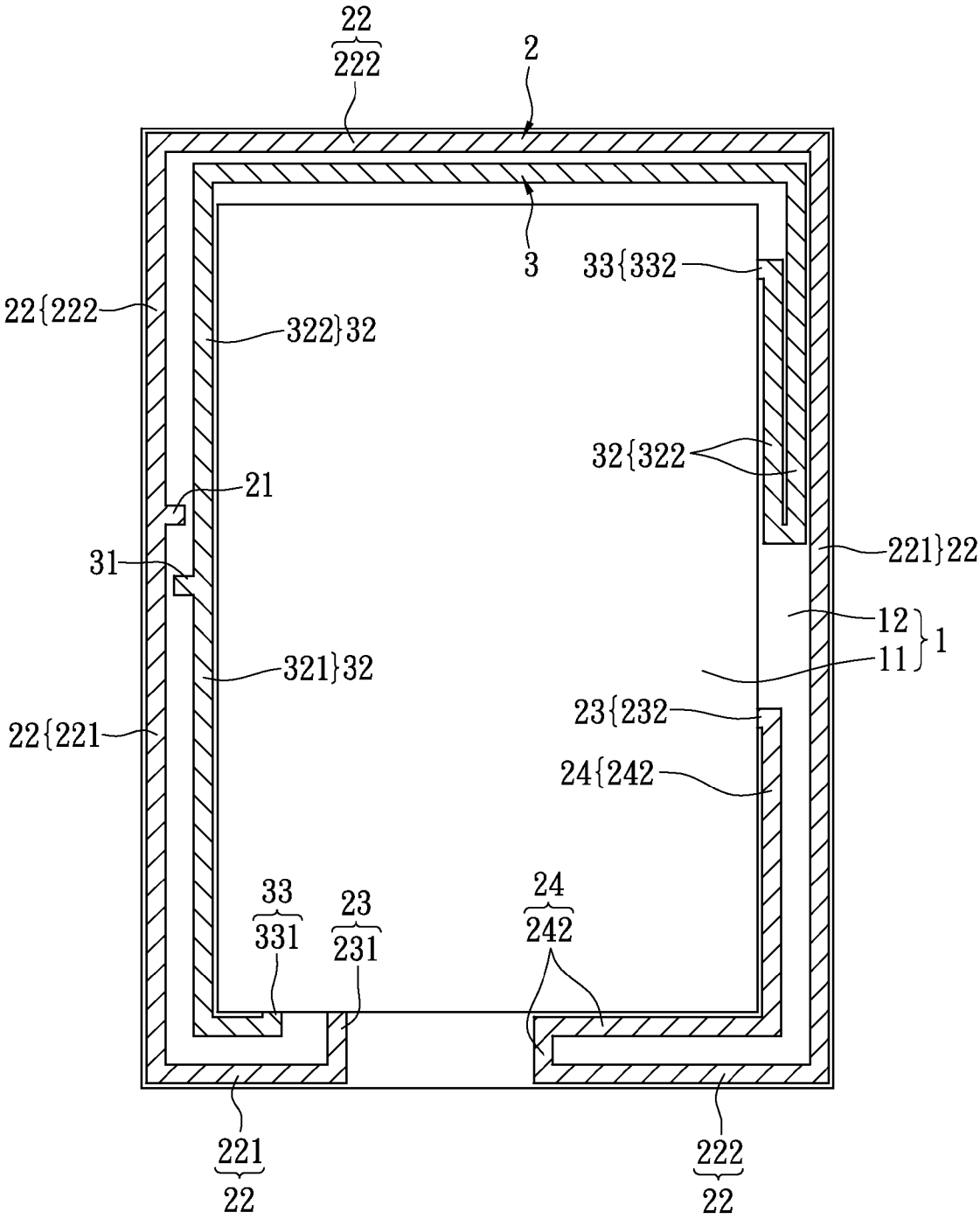
FIG. 8 shows a perspective view of the eighth embodiment in accordance with the present invention.
Figure 9:
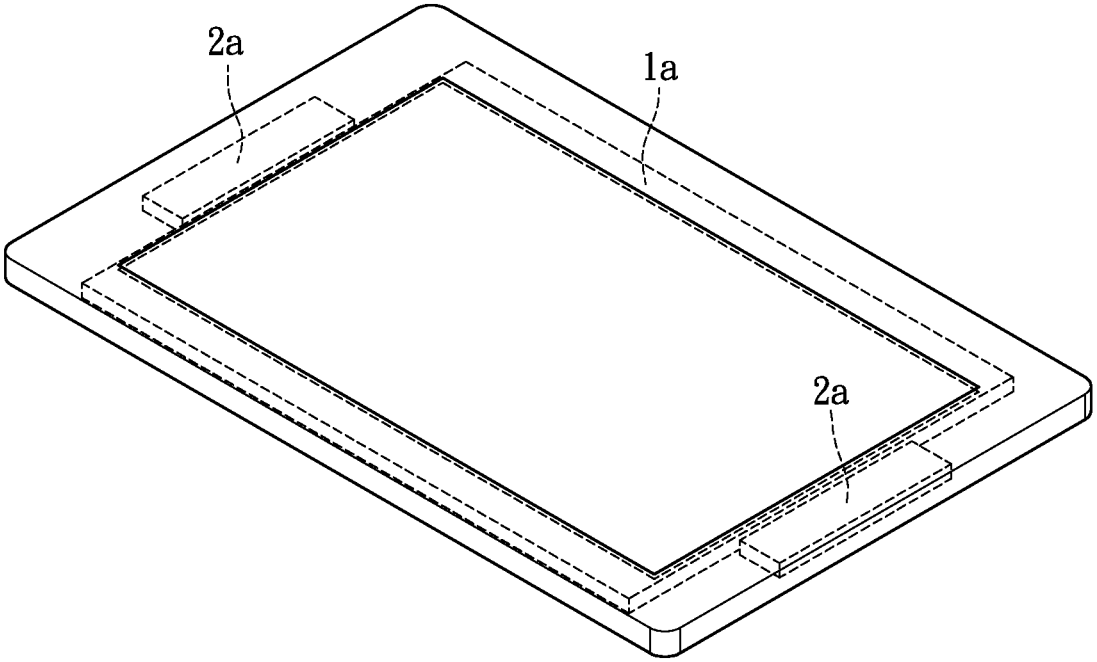
FIG. 9 shows a three-dimensional perspective view of a conventional Smartphone wherein a circuit board and an antenna circuit is embedded within.

Please refer to FIG. 8 which shows the eighth embodiment of the instant embodiment. The instant embodiment is an extended design of the third-fifth embodiments, this implies that the antenna structure in the instant embodiment further includes an inner antenna circuit 3 formed within the antenna circuit 12 and arranged between the antenna circuit 2 and the ground area 11.

The inner antenna circuit 3 includes an inner feeding segment 31, an adjusting segment 32 and at least one inner ground segment 33 wherein the two end portions of the inner ground segment 33 are connected to the end portions of the ground area 11 and the adjusting segment 32.

Specifically, the inner ground segment 33 includes at least one of the high-frequency inner ground segment 331 or the low-frequency inner ground segment 332. The instant embodiment utilizes the existence of both high-frequency inner ground segment 331 and low-frequency inner ground segment 332 for example.

The adjusting segment includes a high-frequency adjusting segment 321 and a low-frequency adjusting segment 322 wherein the high-frequency adjusting segment 321 and the low-frequency adjusting segment 322 are respectively formed by extending oppositely from the inner feeding segment 31, and the length of the high-frequency adjusting segment 321 is shorter than that of the low-frequency adjusting segment 322. The actual length of the high-frequency adjusting segment 321 and the low-frequency adjusting segment 322, however, can be adjusted depending on the given bandwidth.

Furthermore, the two end portions of the high-frequency ground segment 331 are connected to the ground area 11 and the end portion of the high-frequency adjusting segment 321, while the two end portions of the low-frequency ground segment 332 are connected to the ground area 11 and the end portion of low-frequency adjusting segment 322.

In addition, the descriptions of the inner antenna circuit 3 and the antenna circuit 2 are in the third-fifth embodiments wherein the concrete design may not be exactly the same, this implies that the inner antenna circuit 3 and the antenna circuit 2 can be formed depending on the given high-frequency and low-frequency bandwidth, thereby enabling the antenna structure of the present invention to be applicable to four bandwidths.

[Advantages of the Embodiments]

The antenna area 12 of the circuit board 1 of the antenna structure based on the embodiment of the present invention is equivalent to the remaining space on the periphery of a conventional system circuit board 1*a*, and the antenna structure utilizes the antenna circuit 2 formed on the antenna area 12 of the circuit board 1 to achieve a higher space utilization of the circuit board 1 so as to improve the electrical devices to achieve a relatively smaller design.

In addition, the antenna circuit 2 of the present invention can be formed directly on the circuit board 1 during the production thereof, thereby reducing the procedure of manufacturing as well as the production cost.

Furthermore, the antenna structure of the present invention can form two antenna circuits 2, 2' capable of applying to four bandwidths even in cases where no conventional antenna substrate 2*a* is included.

The descriptions illustrated supra set forth simply the preferred embodiments of the present invention; however, the characteristics of the present invention are by no means restricted thereto. All changes, alternations, or modifications conveniently considered by those skilled in the art are deemed to be encompassed within the scope of the present invention delineated by the following claims.

What is claimed is:

1. An antenna structure comprising:

a circuit board wherein at least a surface thereon includes a ground area and an antenna area wherein the ground area is connected with at least one electrical device and the antenna area is substantially rectangular-shaped, arranged between the ground area and the periphery of the circuit board; and at least one antenna circuit formed within the antenna area, wherein the antenna circuit includes a feeding segment, a border segment and at least one ground segment, wherein the feeding segment is connected with the border segment; and the distance from the border segment to the periphery of the circuit board ranges from 0 to 3 millimeters; and the border segment includes at least one 90° bent-structure, an end portion of the ground segment is connected with the ground area, and an end portion of the border segment is connected to the other end of the ground segment.

2. The antenna structure according to claim 1, wherein the antenna circuit includes at least one in-bending segment formed by bending the border segment toward the ground area.

3. The antenna structure according to claim 1, wherein each of the two opposing surfaces of the circuit board includes the ground area and the antenna area, and there are two antenna circuits formed on the antenna area of the two relative surfaces of the circuit board.

4. The antenna structure according to claim 1, further comprising an inner antenna circuit, wherein the inner antenna circuit is formed within the antenna area and arranged between the antenna circuit and the ground area, the inner antenna circuit includes an inner feeding segment, an adjusting segment and at least one inner ground segment, the inner feeding segment is connected to the adjusting segment, the two end portions of the inner ground segment is connected to the ground area and the end portion of the adjusting segment.

5. The antenna structure according to claim 4, wherein the inner ground segment includes a high-frequency inner ground segment and a low-frequency inner ground segment while the adjusting segment includes a high-frequency adjusting segment and a low-frequency adjusting segment, the high-frequency adjusting segment and the low-frequency adjusting segment are respectively formed by extending oppositely from the inner feeding segment, the length of the high-frequency adjusting segment is shorter than that of the low-frequency adjusting segment, the two end portions of the high-frequency inner ground segment are connected respectively with the ground area and the end portion of the high-frequency adjusting segment, the two end portions of the low-frequency inner ground segment are connected respectively with the ground area and the end portion of the low-frequency adjusting segment.

6. The antenna structure according to claim 1, wherein two end portions of the border segment are respectively connected to the other end of the ground segments.

7. An antenna structure comprising:

a circuit board wherein at least a surface thereon includes a ground area and an antenna area wherein the ground area is connected with at least one electrical device and the antenna area is substantially rectangular-shaped, arranged between the ground area and the periphery of the circuit board; and at least one antenna circuit formed within the antenna area, wherein the antenna circuit includes a feeding segment, a border segment and two ground segments, wherein one of the ground segments is a high-frequency ground segment while the other is a low-frequency ground segment, wherein the border segment thereof includes a high-frequency border segment and a low-frequency border segment respectively formed by extending oppositely from the feeding segment, wherein the low-frequency border segment includes at least one 90° bent-structure; and the distance from the border segment to the periphery of the circuit board ranges from 0 to 3 millimeters; and an end portion of each ground segment is connected with the ground area.

8. The antenna structure according to claim 7, the antenna circuit includes a high-frequency extended segment wherein the two end portions of the high-frequency extended segment are connected to the end portion of the high-frequency border segment and the other end of the high-frequency ground segment whereas the end portion of the low-frequency border segment is connected to the other end of the low-frequency ground segment.

9. The antenna structure according to claim 7, wherein the antenna circuit includes a low-frequency extended segment wherein the two end portions of the low-frequency extended segment are connected respectively with the end portion of the low-frequency border segment and the other end portion of the low-frequency ground segment, while the end portion of the high-frequency border segment is connected to the other end of the high-frequency ground segment.

10. The antenna structure according to claim 7, wherein the antenna circuit includes at least one in-bending segment formed by bending the high-frequency border segment toward the ground area.

11. The antenna structure according to claim 7, wherein the antenna circuit includes at least one in-bending segment formed by bending the low-frequency border segment toward the ground area.

12. The antenna structure according to claim 7, wherein each of the two opposing surfaces of the circuit board includes the ground area and the antenna area, and there are two antenna circuits formed on the antenna area of the two relative surfaces of the circuit board.

13. The antenna structure according to claim 7, further comprising an inner antenna circuit, wherein the inner antenna circuit is formed within the antenna area and arranged between the antenna circuit and the ground area, the inner antenna circuit includes an inner feeding segment, an adjusting segment and at least one inner ground segment, the inner feeding segment is connected to the adjusting segment, the two end portions of the inner ground segment is connected to the ground area and the end portion of the adjusting segment.

14. The antenna structure according to claim 13, wherein the inner ground segment includes a high-frequency inner ground segment and a low-frequency inner ground segment while the adjusting segment includes a high-frequency adjusting segment and a low-frequency adjusting segment, the high-frequency adjusting segment and the low-frequency adjusting segment are respectively formed by extending oppositely from the inner feeding segment, the length of the high-frequency adjusting segment is shorter than that of the low-frequency adjusting segment, the two end portions of the high-frequency inner ground segment are connected respectively with the ground area and the end portion of the high-frequency adjusting segment, the two end portions of the low-frequency inner ground segment are connected respectively with the ground area and the end portion of the low-frequency adjusting segment.

15. An antenna structure comprising:

a circuit board wherein at least a surface thereon includes a ground area and an antenna area wherein the ground area is connected with at least one electrical device and the antenna area is substantially rectangular-shaped, arranged between the ground area and the periphery of the circuit board; and two antenna circuits formed within the antenna area and arranged on the two sides of the area bisector of the circuit board in the antenna area, wherein each antenna circuit includes a feeding segment, a border segment and at least one ground segment, wherein the feeding segment is connected with the border segment; and the distance from the border segment to the periphery of the circuit board ranges from 0 to 3 millimeters; and the border segment of each antenna circuit includes at least one 90° bent-structure, and an end portion of the ground segment is connected with the ground area.

16. The antenna structure according to claim 15, wherein each antenna circuit includes at least one extended segment, arranged between the border segment and the ground area; wherein the two end portions of the extended segment are connected respectively with the end portion of the border segment and the other end of ground segment.

17. The antenna structure according to claim 15, wherein each antenna circuit includes at least one in-bending segment formed by bending the border segment toward the ground area.

18. The antenna structure according to claim 15, wherein the two antenna circuits are arranged on the two sides of the diagonal of the circuit board in the antenna area.

19. The antenna structure according to claim 15, wherein each of the two opposing surfaces of the circuit board includes the ground area and the antenna area, and there are two antenna circuits formed on the antenna area of the two relative surfaces of the circuit board.

* * * * *